US007282630B2

(12) United States Patent
Van Vliet

(10) Patent No.: US 7,282,630 B2
(45) Date of Patent: Oct. 16, 2007

(54) SOUNDBOARD FOR A MUSICAL INSTRUMENT COMPRISING NANOSTRUCTURED ALUMINUM MATERIALS AND ALUMINUM MATERIALS WITH NANOSTRUCTURED COMPOSITES

(76) Inventor: Timothy Peter Van Vliet, 7 Cedar Grove Rd., Somerville, NJ (US) 08876

( * ) Notice: Subject to any disclaimer, the term of this patent is extended or adjusted under 35 U.S.C. 154(b) by 0 days.

(21) Appl. No.: 10/948,040

(22) Filed: Sep. 23, 2004

(65) Prior Publication Data

US 2006/0060063 A1 Mar. 23, 2006

(51) Int. Cl.
*G10D 3/00* (2006.01)

(52) U.S. Cl. ..... 84/291

(58) Field of Classification Search ..... 84/291, 84/267

See application file for complete search history.

(56) References Cited

U.S. PATENT DOCUMENTS

| | | | | |
|---|---|---|---|---|
| 451,863 | A | 5/1891 | Springer | |
| 4,031,798 | A * | 6/1977 | Sidner | 84/291 |
| 4,346,639 | A * | 8/1982 | Vagias | 84/437 |
| 5,747,180 | A * | 5/1998 | Miller et al. | 428/601 |
| 5,984,996 | A | 11/1999 | Gonsalves et al. | |
| 6,479,827 | B1 * | 11/2002 | Hamamoto et al. | 250/370.11 |
| 6,653,538 | B1 * | 11/2003 | Wells | 84/291 |
| 6,664,452 | B1 * | 12/2003 | Teel | 84/291 |
| 6,689,192 | B1 | 2/2004 | Phillips | |
| 6,706,324 | B2 | 3/2004 | Chandrasekar et al. | |
| 6,740,287 | B2 | 5/2004 | Billiet et al. | |
| 6,749,827 | B2 * | 6/2004 | Smalley et al. | 423/447.3 |
| 2002/0190441 | A1 * | 12/2002 | Billiet et al. | 264/669 |
| 2004/0247808 | A1 * | 12/2004 | Cooper et al. | 428/36.1 |
| 2005/0038498 | A1 * | 2/2005 | Dubrow et al. | 623/1.15 |
| 2005/0103182 | A1 * | 5/2005 | Spurgeon | 84/291 |

OTHER PUBLICATIONS http://www.pacificnanotech.com/nanostructures_single.html.*
Siegel, Richard W., Creating Nanophase Materials Scientific American, Dec. 1996, pp. 74-79. New York, N.Y.
Kittel, Charles, Introduction to Solid State Physics, seventh edition, 1996, pp. 587-603, John Wiley and Sons. Inc, New York.

* cited by examiner

*Primary Examiner*—Kimberly Lockett

(57) ABSTRACT

The present invention describes the use of nanophase materials, chiefly aluminum, in musical instrument construction. Nanophase materials have constituent grains that are substantially smaller than those of conventional materials, imparting greater strength and deformation resistance. Aluminum has excellent acoustical qualities for making musical instruments, but its use was previously limited due to material weakness of pure aluminum and due to unfavorable, metallic sounding acoustics of aluminum alloys.

The present invention also describes the use of aluminum composites in musical instrument construction to further strengthen the material composition used. The use of nanostructured materials in musical instrument construction, e.g. to make soundboards, provides exceptional, premier acoustical qualities as well as great strength and durability.

4 Claims, 6 Drawing Sheets

SOUNDBOARD FOR A MUSICAL INSTRUMENT COMPRISING NANOSTRUCTURED ALUMINUM MATERIALS AND ALUMINUM MATERIALS WITH NANOSTRUCTURED COMPOSITES

CROSS-REFERENCE TO RELATED APPLICATIONS

Not Applicable

FEDERALLY SPONSERED RESEARCH

Not Applicable

SEQUENCE LISTING OR PROGRAM

Not Applicable

BACKGROUND OF THE INVENTION

1. Field of Invention

This invention relates to the use of nanostructured materials and aluminum composite materials in musical instrument construction.

2. Prior Art

This invention relates to the material composition of vibrating components in musical instruments. A class of instruments herein specified, are those whose initial tone is produced by a vibrating string. Sound from this string is amplified by the sympathetic vibration of one or more soundboards. Examples of such instruments include bowed instruments of the violin family, plucked instruments of the guitar family, as well as keyboard instruments such as the piano. It is desirable for soundboards to be made from a material that has lasting strength and durability as well as favorable acoustical properties.

In musical instruments where a soundboard is required, the quality or "color" of ultimate tone produced, as also its relative amplitude, depends to a large measure on the inherent physical properties of the material composing the soundboard(s), apart from mere structure. At present, the dominating practice is to construct such soundboards of wood, the selection of which is comparatively limited, as most woods are unsuited for the purpose. The cost of these instruments is relatively high due to the skilled craftsmanship involved and individual attention needed to produce articles of wood. There are also high materials cost, as the preferred woods, like spruce, maple, and mahogany, besides scarcity, must be carefully cut and patiently dried, often for years, before use. Wood laminate construction is cheaper than solid wood, but is subject to separation of the glued layers. Wood altogether has inherent irregularities that can result in unpredictable, undesirable, and irregular sound qualities of the finished instrument. Instruments made with wooden soundboards can also be damaged by a number of physical elements.

While some instrument soundboards have been made of carbon based composite materials, such instruments commonly have poor acoustics due to an excess of high frequencies produced. This is due to carbon composites' lesser absorption of high frequencies when compared to wood. Also, carbon composites can be brittle.

Previous attempts have been made to construct soundboards of various metals, in order to achieve both durability and cheaper manufacturing costs. However, these efforts have been generally failures, as the vibrations of the metal produced a sharp and disagreeable tone quality commonly known as "metallic". The metallic sound quality is a result of maintenance of comparatively continuous and uniform higher upper partial tones. In most metals, these tones are inharmonic secondary tones that result in a peculiar, poor quality. This poor quality arises from the comparative strength of these upper partials as related to the fundamental induced frequency. The cause of metallic sounding vibrations is described by acknowledged material science as an inherent property of most metals, a notable exception of which is aluminum.

Noticing the unique acoustical properties of aluminum, Alfred Springer obtained U.S. Pat. No. 451,863 issued on May 5, 1891. Springer discusses the use of aluminum and its alloys to manufacture the soundboards of musical instruments. Pure aluminum possesses elasticity capable of sympathetic vibration uniformly through a wide range of tone-pitch, which renders it in this respect superior to wood. Springer had constructed a prototype violin of aluminum, finding its tone to indeed be comparable to or surpassing that of highly valued older instruments. Springer's aluminum instruments also had the advantage of greater carrying power and an absence of certain imperfections in certain portions of the scale known as "wolf tones". While pure aluminum has excellent acoustical qualities, Springer's instruments however have important shortcomings.

While pure aluminum, as conventionally manufactured, has favorable acoustical qualities, it is flimsy, weak, and easily deformed. Analysis of aluminum metal shows that conventional manufacturing techniques result in a metal composed of micron scale grains, of order a millionth of a meter in size. As conventionally manufactured with micron scale grains, pure aluminum is subject to permanent, plastic deformations, such as slippage as well as screw and edge type dislocations unless substantially alloyed. (For a brief explanation of deformations in metal, see Kittel, Charles, Introduction to Solid State Physics, seventh edition pp. 587–603.)

While Springer discusses the use of commercial aluminum alloys to satisfy strength and hardness requirements, the sound quality of the aluminum metal plates in fact becomes increasingly metallic with added alloy content. The problem with soundboards made of conventional aluminum alloys is that basic strength and durability requirements required an alloy content exceeding the amount that results in an unfavorable, metallic sound quality. (Alternatively adding extra structural supports to a soundboard would force additional acoustical nodes, preventing free vibration of the plate.) The present invention is distinguishable in that it uses nanostructured materials, such as substantially finer grained aluminum, (that may be further strengthened with composites) in musical instrument construction. Use of these materials solves materials' deficiencies of the prior art by strengthening aluminum without detriment to its acoustical properties.

Nanostructured (also known as "nanophase" and "nanocrystalline") materials, are a new kind of material with constituent grains (crystals) that are substantially smaller than those of their conventionally manufactured counterparts. These grains are generally less than a micron and can be 1–100 nanometers in size. In nanophase materials, the smaller size constituent crystals or grains impart greater hardness, strength, and deformation resistance. (For a brief general introduction to the subject of nanophase materials, see Siegel, Richard W., Creating Nanophase Materials, Scientific American, December 1996, pp. 74–79.)

While nanophase materials are disclosed in the prior art, the use of nanophase materials for musical instruments is not. The following are relevant prior art that relate to the manufacture of articles from nanophase materials although they do not disclose the application to musical instrument construction.

U.S. Pat. No. 5,984,996 issued on Nov. 16, 1999 to Kenneth E. Gonsalves, and Sri Prakash Rangarajan, describes nanostructured metals, metal carbides and metal alloys, including the production of nanophase aluminum powders through chemical reaction and subsequent collection. The present invention is distinguishable, in that it makes use of nanophase materials for musical instruments.

U.S. Pat. No. 6,689,192 B1 issued on Feb. 10, 2004 to Jonathan Phillips, William Perry, and William Kroenke, describes a method for producing metallic nanoparticles by vaporizing an aerosol of metallic microparticles in a non-oxidizing plasma. The vapor is then directed away from the hot plasma to allow metallic nanoparticles to condense. The present invention is distinguishable, in that it makes use of nanophase materials for musical instruments.

U.S. Pat. No. 6,740,287 B2 issued on May 25, 2004 to Romain L. Billiet and Hanh T. Nguyen, describes a multi step method for method for making metal articles from nanoparticulate material. The present invention is distinguishable, in that it makes use of nanophase materials for musical instruments.

U.S. Pat. No. 6,706,324 B2 issued on Mar. 16, 2004 to Srinivasan Chandrasekar, Walter D. Compton, Thomas N. Farris, and Kevin P. Trumble, describes a procedure for obtaining metals that include nanophase microstructures (grains). The nanocrystalline microstructures are obtained by strain deformation resulting from mechanical machining of metal into small chips, particles, ribbons, or platelets. The resulting chips are then used in forming an article of metal. The present invention is distinguishable, in that it makes use of nanophase materials for musical instruments.

OBJECTS AND ADVANTAGES

Musical instrument soundboards comprising nanophase aluminum can provide acoustics surpassing those of wood and carbon composites while providing lasting strength and durability. Alternatively, the soundboards can further comprise composite materials, either metal or ceramic for additional added strength without detriment to the sound.

Pure or nearly pure aluminum (both nanophase and conventional) possesses elasticity capable of sympathetic vibration uniformly through a wide range of tone-pitch, which renders it in this respect superior to wood and carbon based composites. Aluminum soundboards have the advantage of greater carrying power compared to wood, allowing the stronger amplification of the fundamental frequency produced. A further advantage is an absence of certain imperfections in certain portions of the scale known as "wolf tones". Aluminum lacks an excess of high frequencies produced and lacks the propagation of inharmonic upper partial frequencies that would render the sound "metallic". This is due to aluminum's absorption of high frequencies, which is similar to that of the best wooden soundboards.

The present invention is distinguishable in that it uses nanophase materials to overcome the weakness of conventional aluminum without substantial alloying. Nanophase materials are a new kind of material having constituent grains that are substantially smaller than those of their conventionally manufactured counterparts. In nanophase materials, the smaller size constituent grains impart greater hardness, strength, and deformation resistance. Nanophase metal articles can be manufactured from nanophase powders or from nanostructured metal chips.

Nanophase aluminum shares the favorable acoustical properties of conventional aluminum. Having the advantage of greater strength of the nanophase aluminum over conventional aluminum in a sheet of metal, there is freedom to lessen or eliminate the alloy content for optimal acoustics. Minimizing or eliminating the alloy content is desirable since the sound quality of aluminum metal plates becomes less metallic with less alloy content. Nanophase materials can be further strengthened and stiffened with a number of composites to further tailor the metal's properties for specific soundboard applications. Therefore, nanophase materials overcome the prior art in both acoustical quality and lasting strength and durability. Accordingly, several objects and advantages of the present invention are:

(a) to provide a musical instrument soundboard with favorable acoustical qualities that surpass those of wood and carbon composites.
(b) to provide a musical instrument soundboard with strength and durability greater than that of wood, carbon composites, or conventional aluminum.
(c) to produce metal soundboards whose tone lacks metallic characteristics.
(d) to provide musical instruments of predictable and reproducible sound quality.
(e) to provide a soundboard that does not deteriorate with age, physical elements, or weather.
(f) to provide soundboards in which the manufacturing process is uniform and scaleable.

SUMMARY

In accordance with the purposes of the present invention, as embodied and broadly described herein, the present invention describes the use of nanophase materials, chiefly aluminum, in musical instrument construction. Nanophase materials have constituent grains that are substantially smaller than those of conventional materials. The present invention also describes the use of aluminum composites in musical instrument construction to further strengthen the material composition used. Use of these materials in musical instrument construction, e.g. to make soundboards, provide exceptional, premier acoustical qualities as well as great strength and durability.

DRAWING

Figures

REFERENCE NUMERALS

Figure 1A:
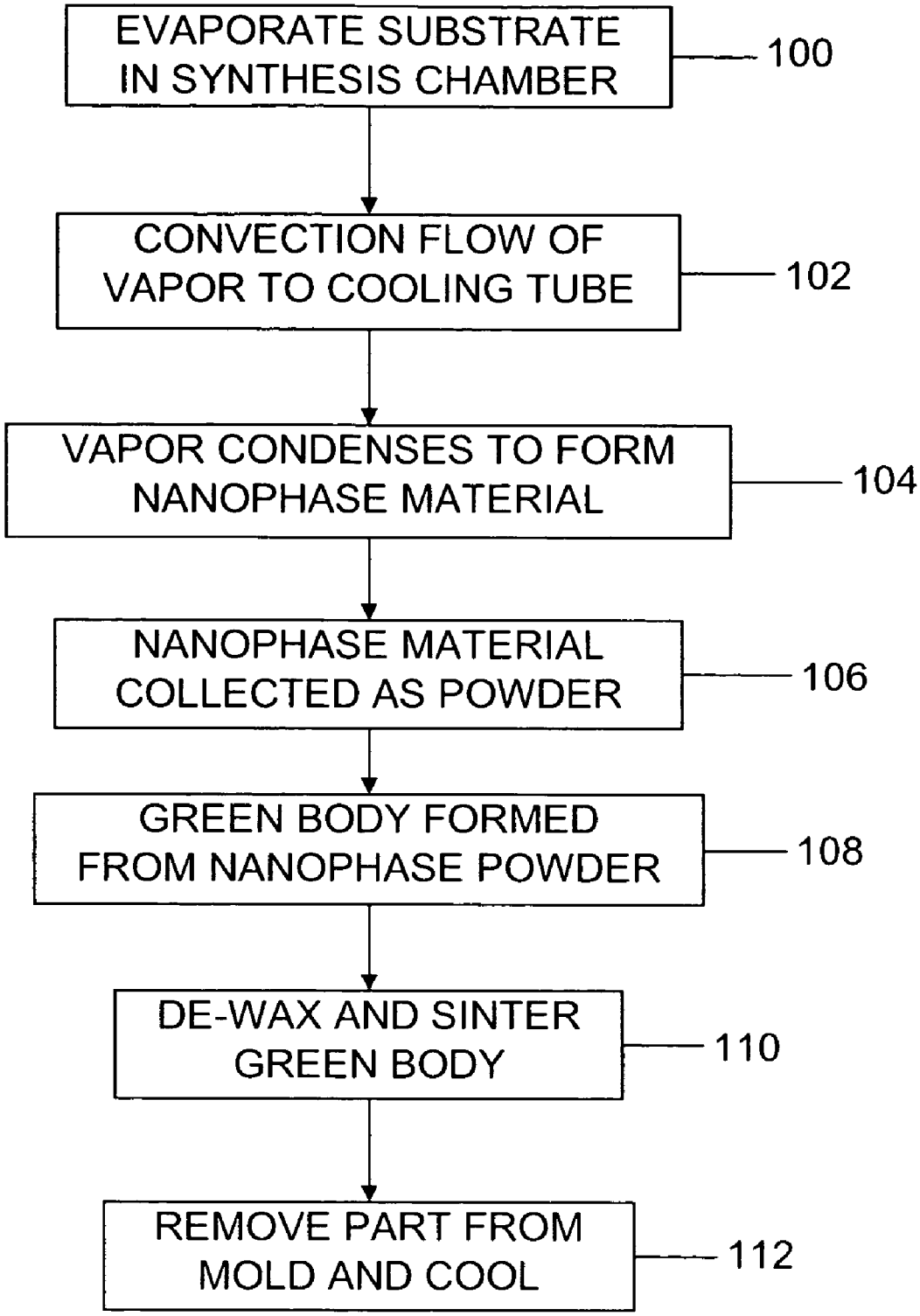
FIG. 1A is a flow chart outlining processes typically used in forming articles from nanophase metal powders.

10 Front soundboard plate of a violin
12 Back soundboard plate of the violin

14 Sides of the violin
16 Sound-post
18 Seams
20 Bridge
22 Tailpiece string holder
24 Neck
26 Fingerboard
28 Sound-hole
30 Violin
32 Cabinet
34 Piano soundboard
36 Edge supporting frame (rim)
38 Supporting truss work
40 Piano soundboard assembly
100 Process: Evaporate Substrate in Synthesis Chamber
102 Process: Convection Flow of Vapor to Cooling Tube
104 Process: Vapor Condenses to Form Nanophase Material
106 Process: Nanophase Material Collected as Powder
108 Process: Green Body Formed From Nanophase Powder
110 Process: De-wax and Sinter Green Body
112 Process: Remove Part From Mold and Cool
200 Process: Mechanically Machine Body Into Chips Having Nanocrystalline Microstructures
202 Process: Comminution of Metal Chips, E.G. Ball Milling
204 Choice of Processes: Direct Consolidation or Incorporation into Matrix
206 Process: Consolidate and Sinter into Monolithic Metal Article
208 Process: Incorporate Chips into Metal or Metal Alloy Matrix, e.g. by Melt Infiltration

DETAILED DESCRIPTION OF THE PREFERRED EMBODIMENTS

The present invention describes the use of nanostructured materials and aluminum composite materials in musical instrument construction, e.g. to make sheet metal soundboards or percussion instruments. The sheet metal is preferably comprised of nanostructured aluminum or nanostructured aluminum with minimal alloy content. One general method of making nanostructured (nanophase) metals is outlined in FIG. 1A in which metal articles are made from nanoscale (ultra-fine) powders. This method is further detailed in Subsection 1A. An alternative manufacturing method is outlined in FIG. 1B in which a body is mechanically machined into nanostructured chips that are then used in forming or reinforcing a metal article. This method is further described in Subsection 1B. Subsection 1C describes additional aluminum composite materials that can be used to further reinforce aluminum in musical instrument construction.

Figure 2A:
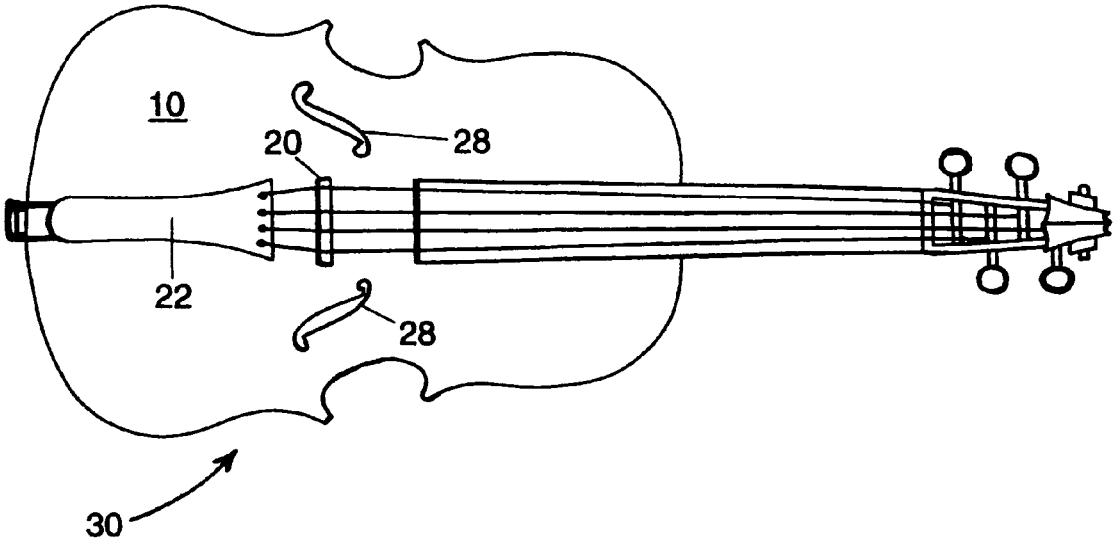
FIG. 2A shows a front view of a violin.
Figure 2B:
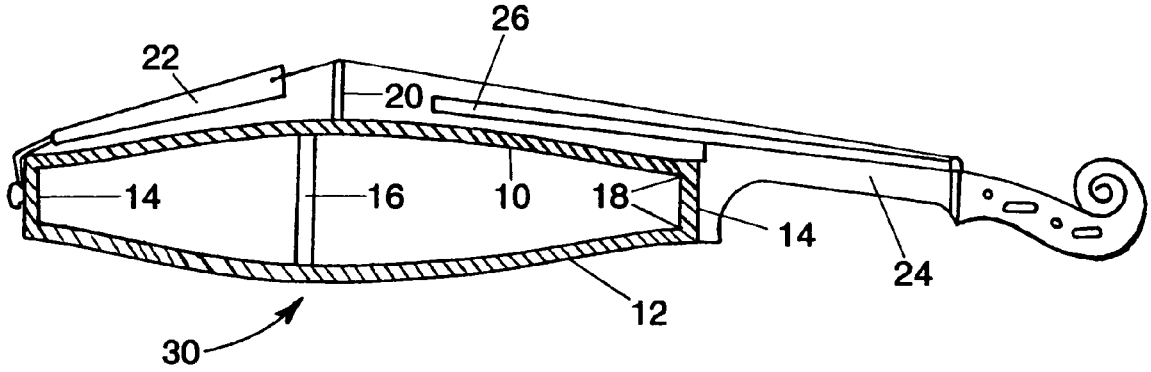
FIG. 2B shows a side cross sectional view of the violin.

Subsection 2 describes a violin 30 shown in FIGS. 2A and 2B, an embodiment of the current invention. Subsection 3 describes a piano soundboard assembly 40 shown in FIG. 3A and FIG. 3B, another embodiment of the current invention. Vibrating components of musical instruments, such as violin and piano soundboards, are to preferably comprise nanophase materials.

Subsection 1A: Producing Nanophase Powders and Articles Made from them

Figure 1B:
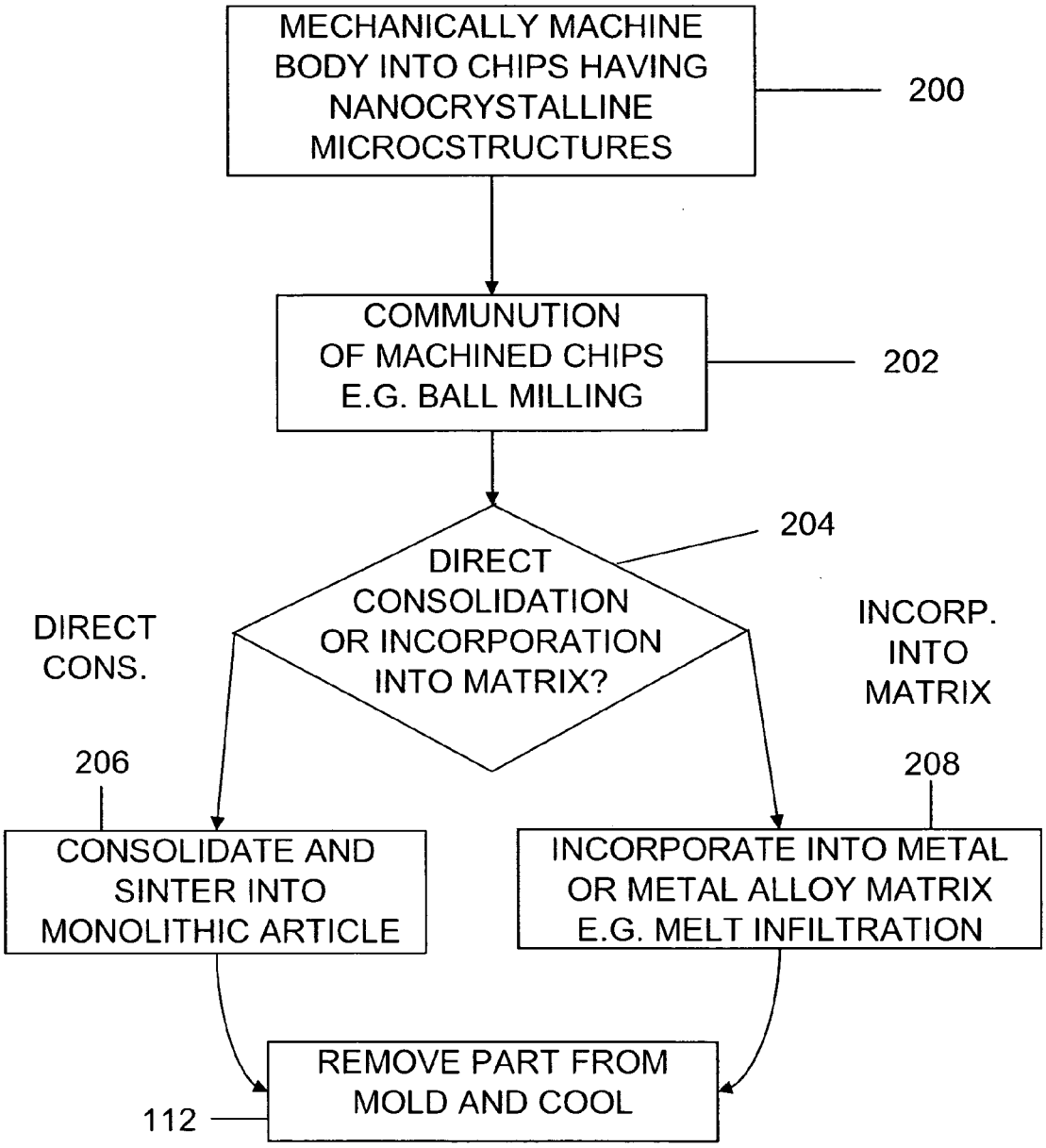
FIG. 1B is a flow chart outlining alternative processes in which mechanically machined chips having nanocrystalline structures are used to form metal articles.

In one general method of making nanophase metals, nanoscale powders are made and then formed into a metal article as outlined in FIG. 1A flowchart. Nowadays, nanoscale metal powders, including aluminum, are available from a number of different powder suppliers on a commercial scale. Grain sizes in nanophase materials can be 1–100 nanometers (grains following a size distribution according to manufacturing method). One can use commercially available aluminum powder having average grain size of about 50 nanometers. The preferable aluminum powder has with minimal, if any alloy content. Deformation resistance of the finished product increases with decreasing size of its metallic grains. So grain sizes should be minimized. Nanophase powder is also preferably free of aggregates and contamination to the extent practical.

Smaller metallic grain sizes are what constitute the difference between nanophase and conventional materials. Grains in conventional materials range from microns to millimeters in diameter, with each grain containing several billion atoms. Grains in nanophase materials are less than a micron across and generally less than one hundred nanometers in diameter, containing fewer than tens of thousands of atoms. Because of the small size of their grains, nanophase materials have several unusual properties, including much greater strength because of the absence of significant dislocations between the grains. Nanophase aluminum, in addition, has favorable acoustical qualities that make it desirable for musical instrument making.

In one method of making nanoscale metal powders (further described in the prior art and outlined in FIG. 1A), a conventional metal substrate is heated in a vacuum in a synthesis chamber to a temperature at or above its boiling point. This causes atoms (or molecules) to evaporate from the surface of the substrate (process 100). Gas convection flow causes the vapor thus formed to move from the synthesis chamber through a conduit to a cooling tube (process 102). The cooling tube may be surrounded by a refrigerant such as liquid nitrogen. Since a metallic nanophase product is desired, the cooling tube can be filled with an inert gas such as helium, which will absorb heat from the vapor without reacting with it. Under controlled conditions of temperature and pressure, contact with the cold gas will cause the atoms or molecules of the vapor to condense into very small clusters known as grains (process 104). The nanophase metal is then collected as a powder (process 106).

Nanophase aluminum can also be obtained through a chemical reaction and then refined. For example prior art U.S. Pat. No. 5,984,996 describes the process of reacting one part of $AlCl_3$ with four parts of $LiAlH_4$ in refluxing mesitylene to yield a black precipitate. The solvent is then removed by vacuum distillation, yielding a powdery residue. The lithium chloride by-product is then removed by washing the powdery residue with pentane, followed by sublimation of remaining lithium chloride at 700 degrees C. for 4 hours at $10^{-4}$ torr.

An alternative method of continuously producing nanophase metal powder is further described in prior art U.S. Pat. No. 6,740,287 B2. This method of powder production involves a process in which an aerosol of metallic microparticles is directed into a non-oxidizing plasma hot zone that is hot enough to vaporize the particles. The metallic vapor is then directed away from the plasma and allowed to cool under controlled temperature and pressure to form metallic nanoparticles. Nanoparticles of desired size are then collected. It may be useful to transport the nanophase metal powders mixed with an inert gas or inert liquid such as an organic fluid. Such transport is useful to prevent oxidation of nanoscale powders.

Once the aluminum nanophase powder is obtained, the powder must then be formed into nanostructured metal parts, such as the sheet metal soundboards. For greatest strength, the metal formed should be as dense and nonporous as possible. While there are variations among manufacturing techniques of making objects from nanophase powdered metals, generally the metal powder is sintered. In the sintering process, the powder is heated until the grains exchange atoms or molecules, and so bond to form a solid mass. The sintering process is to be optimized to have a minimum amount of grain growth (by variation in variables such as temperature and duration). Alternatively, the powder may be mixed with a liquid and allowed to dry before sintering. (This is called slip forming.)

The forming of desired metal parts from nanophase metal powder can also be done by integrating the following steps (described in further detail in prior art U.S. Pat. No. 6,740,287 B2)

1. Attriting precursor nanophase metal powders
2. Desorbing the exposed surfaces of the exposed nanoparticles
3. Adsorbing a surfactant on at most 50% of the desorbed surfaces,
4. Dispersing the surfactant-coated nanoparticles in an organic matrix to form a homogeneous thermoplastic compound from which, the green bodies are shaped (for example by molding) (process 108)
5. De-wax and sinter the green body (process 110)
6. Remove part from mold and cool (process 112)

In summery, the above steps in this subsection, outlined in FIG. 1A flowchart, explain how to make objects from nanophase metal powders such as aluminum. If necessary, the parts can be further shaped using ordinary machining and/or sheet metal tools, such as by rolling, cutting, drilling, bending, or grinding.

Subsection 1B: Mechanically Machining a Body into Nanostructured Chips that are then Used in Forming or Reinforcing a Metal Article An alternative manufacturing process for making metals comprising nanostructured materials is outlined in FIG. 1B. This process is further described in more detail in prior art U.S. Pat. No. 6,706,324 B2 and can be used to form nanostructured aluminum. In this method, a body is mechanically machined into chips having nanocrystalline microstructures (also known as nano-size grains). The chips undergo a large strain deformation process from the controlled machining that causes the smaller grains to form. The chips are then used in forming or reinforcing a metal article. Making nanostructured materials from mechanically machined chips is useful since it is currently less expensive than forming articles form powders produced from metallic vapor condensation.

Summarizing the manufacturing process, a cutting or abrasion tool machines a body into chips having nanocrystalline microstructures formed as result of sufficiently large strain deformation (process 200). The cutting angle or abrasion process (causing the strain deformation) should be optimized to produce chips with the finest possible metallic grains. A range of 30–500 nanometer grain sizes have been successfully produced. The resulting chips can have the shape of particulates, ribbons, wires, filaments, and/or platelets. The chips can be mechanically ground into smaller pieces (known as the process of communition) (process 202) using methods such as ball milling, attrition, or jet milling.

There is then a choice of manufacturing processes (204), one of which is direct consolidation of the chips into a monolithic article. Another choice is incorporation into a metal matrix. In direct consolidation, the chips are used to form a monolithic article, (process 206), e.g. by sintering. For monolithic articles, it is desirable for the body from which the chips are machined to be made of aluminum or minimally alloyed aluminum for acoustical reasons. In the sintering process, it is desirable to minimize the growth of constituent crystals (grains) and maximize the density of the resulting article for maximum strength.

In matrix incorporation (process 208), the chips are dispersed in a matrix metal material to form a composite in which the chips serve as reinforcement material. In the case of using the chips as reinforcement material, the chips can be broken into specific shapes that are the most useful for reinforcement. The matrix metal as well as the majority of the nanostructured chips are preferably made from aluminum or minimally alloyed aluminum. Some of the embedded chips can be made from dissimilar metals or ceramic materials to form a composite, without detriment to the sound. The use of composites is further discussed in subsection 1C. For matrix metal incorporation, it is desirable to minimize the amount of the weaker, larger, conventional grained aluminum matrix metal by keeping the content of nanostructured aluminum chips as high as possible.

Methods of forming a composite material from the chips include melt infiltration, stir-casting, sintering, and extrusion. The use of metallic nanocrystalline reinforcement chips can also offer significantly improved wetting for liquid state processing of conventional reinforcement materials, such as ceramic silicon carbide.

Once again, after the parts are formed, the article is then removed from the mold and cooled (process 112). If necessary, the parts can be further shaped using ordinary machining and/or sheet metal tools, such as by rolling, cutting, drilling, bending, or grinding.

Subsection 1C: Aluminum Composites

This section describes aluminum composite materials that can be useful in musical instrument making. The composites can be used to further stiffen aluminum, the aluminum which may comprise nanostructured grains. While nanostructured aluminum is sufficiently strong for musical instrument construction, it may be desirable to further stiffen vibrating components for acoustical reasons. For example, the back of a hollow bodied string instrument is typically made of stiffer material than the top. The usual aluminum composites used in aerospace applications contrast in that they further strengthen highly alloyed aluminum. It is not desirable to substantially alloy aluminum for musical instrument construction since it would render the sound metallic.

Choices for composite reinforcement materials include ceramic materials such as (but not limited to) silicon carbide, alumina, and silicon nitride. The shapes of the reinforcement can be particles, filaments, fibers, or whiskers, among other shapes. Composite reinforcement materials can also include graphite (usually in fibers), boron fiber, or boron carbide.

Methods of incorporating composite materials include melt infiltration, sintering, and powder metallurgy, well established in industry. Composite materials (e.g. ceramics) can be nanostructured themselves, for example, chips produced by mechanical machining processes described in U.S. Pat. No. 6,706,324 B2.

Composite materials comprising nanostructured aluminum can provide excellent acoustics, similar to unalloyed aluminum while still providing ample strength and durability in musical instrument construction. Like all composites, aluminum composites are not a single material but a family of materials whose stiffness, strength, density, and thermal properties can be tailored. The reinforcement material, volume and shape of the reinforcement, and the fabrication method can all be varied to achieve required properties.

Subsection 2: Violin Incorporating Nanophase Materials

Generally analogous to traditional instruments, this subsection describes a violin whose vibrating components (e.g. soundboards) comprise the above described nanophase materials. Representative of hollow bodied instruments, FIG. 2A shows the front view of a violin 30 and FIG. 2B shows a side view of the violin 30. The violin 30 comprises a sheet metal front soundboard 10, a sheet metal back soundboard 12, and sheet metal sides 14. Different parts of the instrument, such as the front and back can be tailored to have different thicknesses, stiffness, and densities by variation in material composition used. A bridge 20 transmits vibrations from the string to the front plate. A soundpost 16 transmits vibrations from the front to the back plate. Strings are supported by a tailpiece 22 at one end and a neck 24 at the other having a mounted fingerboard 26. One or more sound holes 28 are cut into the top plate. Instruments can be made in pieces in which are then joined together at seams 18, e.g. by welding.

Portions of the instrument in which the material composition is not critical to the overall sound produced can be manufactured from dissimilar materials. For example, the fingerboard 26 can be made of graphite. Strings themselves can be made from a variety of materials as they are traditionally.

A longitudinal bass bar (not shown) is fitted to the underside of the violin top. Also not shown, the soundboard edge can have inlay, for example near the plate's edge.

Subsection 3: Piano Soundboard Assembly Incorporating Nanophase Materials

Figure 3A:
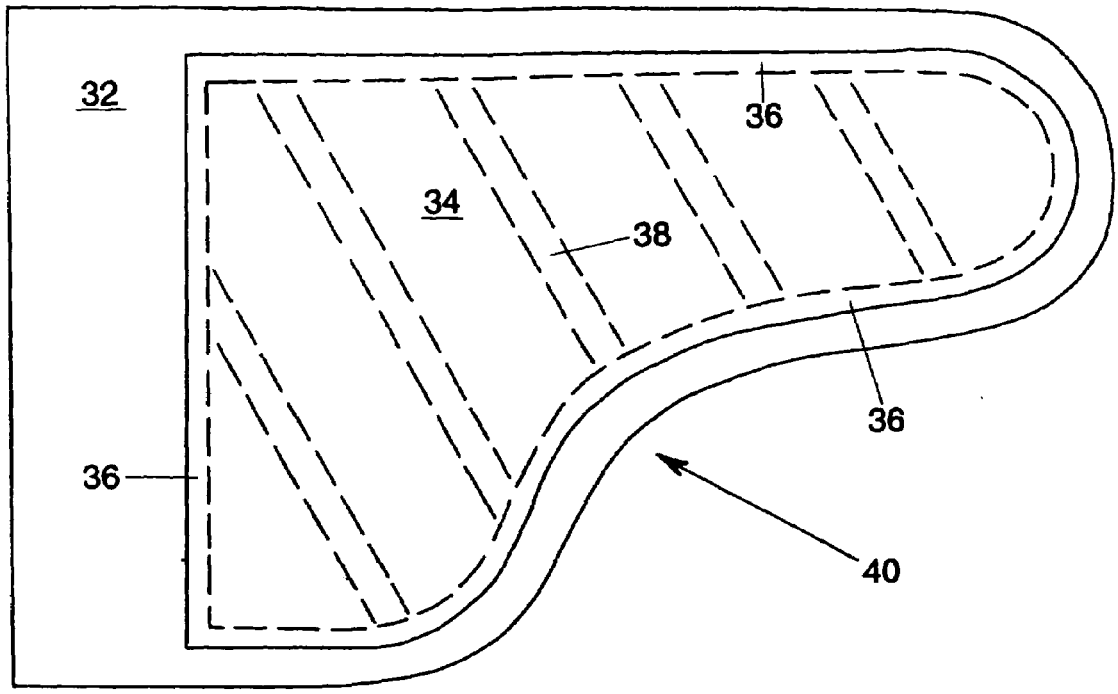
FIG. 3A shows a top view of a mounted piano soundboard.
Figure 3B:
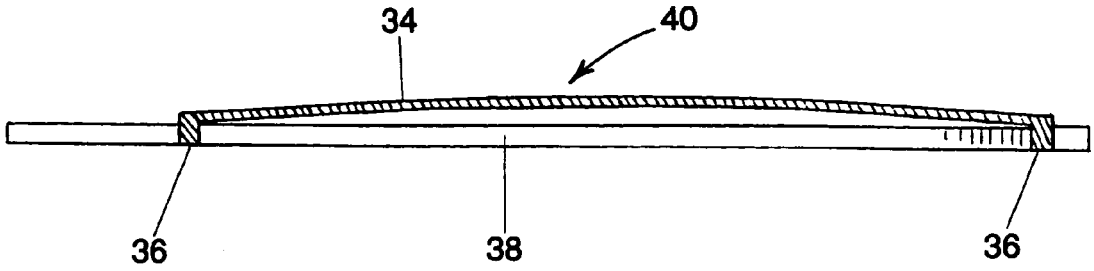
FIG. 3B shows a side cross sectional view of the mounted piano soundboard.

Another embodiment of the current invention is a soundboard for a keyboard instrument made of sheet metal. FIG. 3A shows the top view of a mounted soundboard for piano 40. FIG. 3B shows the side view of the mounted piano soundboard assembly 40 as viewed from its edge. The sheet-metal soundboard 34 is of suitable thickness and preferably welded to an edge-supporting metal frame 36. The frame 36 can be made of conventional materials. The piano soundboard preferably has an arching crown shape to it as shown in the profile view. The piano soundboard can be reinforced with a plurality of ribs analogous to traditional construction. The ribs are not shown, although they can comprise nanopahse materials. The usual cabinet 32 encases the soundboard assembly and is reinforced by the usual supporting truss work 38.

CONCLUSION, RAMIFICATIONS, AND SCOPE OF INVENTION

Accordingly, although the description above contains many specificities, these should not be construed as limiting the scope of the invention but as merely providing illustrations of some of the presently preferred embodiments of the invention. For example, there are many possible variations in the material compositions and many possible variations in their manufacturing processes that could be adopted by anyone skilled in the art. The present invention covers the use of nanophase materials in any musical instrument. Thus the scope of the invention should be determined by the appended claims and their legal equivalents rather than by the examples given.

I claim:

1. A metal soundboard for a musical instrument, said soundboard serving to amplify and enhance sound, wherein the metal is primarily made of metal selected from the group consisting of, pure aluminum, nearly pure aluminum, and aluminum with low alloy content, wherein said metal soundboard, structure consists of a significant portion of said selected metal being nanostructured, said nanostructured portion of the selected soundboard metal is a primarily aluminum composition that is resistant to shape deformation, in a manner whereby preserving the unique acoustical properties of unalloyed aluminum, primarily that the soundboard also substantially lacks metallic overtones.

2. A metal soundboard for a musical instrument, said soundboard serving to amplify and enhance sound, wherein the metal is primarily made of metal selected from the group consisting of, pure aluminum, nearly pure aluminum, and aluminum with low alloy content, wherein said metal soundboard, structure consist of a significant portion of nanostructured composite materials, said nanostructured composite materials portion of the primarily aluminum metal soundboard is a composition that is resistant to shape deformation, in a manner whereby preserving the unique acoustical properties of unalloyed aluminum, primarily that the soundboard also substantially lacks metallic overtones.

3. A metal soundboard for a musical instrument according to claim 2, wherein said nanostructured composite materials are selected from the group consisting of silicon carbide, alumina, silicon nitride, graphite, boron, and boron carbide.

4. A metal soundboard for a musical instrument according to claim 2, wherein said nanostructured composite materials are shapes selected from the group consisting of particles, filaments, fibers, whiskers, and chips.

* * * * *